United States Patent [19]

Kelly

[11] Patent Number: 4,860,514

[45] Date of Patent: Aug. 29, 1989

[54] SINGLE PLY ROOF MEMBRANE SECURING SYSTEM AND METHOD OF MAKING AND USING SAME

[76] Inventor: Thomas L. Kelly, 31 Sands St., Waterbury, Conn.

[21] Appl. No.: 196,884

[22] Filed: May 19, 1988

Related U.S. Application Data

[63] Continuation of Ser. No. 921,409, Oct. 22, 1986, abandoned.

[51] Int. Cl.[4] ..... E04D 5/10

[52] U.S. Cl. ..... 52/410; 52/512; 52/746

[58] Field of Search ..... 52/309.2, 309.5–309.9, 52/309.11, 405–411, 506, 512, 520, 544, 746

[56] References Cited

U.S. PATENT DOCUMENTS

| | | | |
|---|---|---|---|
| 3,505,770 | 4/1970 | Bennett | 52/408 X |
| 3,765,140 | 10/1973 | Harry | 52/409 |
| 4,074,492 | 2/1978 | Simpson et al. | 52/419 |
| 4,162,597 | 7/1979 | Kelly | 52/410 |
| 4,282,050 | 8/1981 | Thiis-Evensen | 156/71 |
| 4,389,826 | 6/1983 | Kelly | 52/410 |
| 4,437,283 | 3/1984 | Benoit | 52/410 |
| 4,441,295 | 4/1984 | Kelly | 52/408 |
| 4,452,023 | 6/1984 | Stahlberg | 52/378 |
| 4,462,194 | 7/1984 | Wahner | 52/309.11 |
| 4,493,175 | 1/1985 | Coppola, Jr. | 52/410 |
| 4,554,773 | 11/1985 | Conley | 52/521 |
| 4,712,348 | 12/1987 | Triplett et al. | 52/408 |

OTHER PUBLICATIONS

Braas Bulletin 1106, ID No. FOKB1,500, Apr. 1, 1977, 2 pages, having material printed on the front and back of each page.

The Construction Specifier Article by Herbert B. Fishman, Jan. 1987, pp. 74–80.

*Primary Examiner*—James L. Ridgill, Jr.

*Attorney, Agent, or Firm*—Barnes & Thornburg

[57] ABSTRACT

A single ply roof installation and method of making and using the same is disclosed. Flexible material securing units are provided for attaching to the underside of the membrane sheets. These securing units have a varying thickness across the surface area and are disposed in the field of the roof so as to attach to the membrane at the seam area of overlapping membrane sheets. Certain embodiments include securing units made of two pieces of the membrane material each piece having a different size, with the pieces welded together by heat or solvent welding. The securing units are distributed in the field of the roof in a regular pattern along seam sections adjoining sheets of the roofing membrane.

64 Claims, 3 Drawing Sheets

SINGLE PLY ROOF MEMBRANE SECURING SYSTEM AND METHOD OF MAKING AND USING SAME

This is a continuation of application Ser. No. 921,409, filed Oct. 22, 1986, now abandoned.

BACKGROUND AND SUMMARY OF THE INVENTION

Single ply membrane roofing systems using EPDM rubber, polyvinylchloride (PVC), and other synthetic material single layer sheets as the top layer of water impervious material were introduced on a large scale to the roofing industry several years ago. The single ply membrane roofing systems are especially advantageous for flat or low pitch roofs, such as are found in most large commercial buildings such as office buildings, shopping centers and the like. The use of such single ply membranes is increasing due to inherent advantages of same over older systems, such as built up roofs formed of layers of tar and paper material (BUR), because of weathering and the lower roof loading weights and the savings in costs for an installed roof.

Since the introduction of such single ply roofing systems on a large scale, there have evolved many different methods of attaching these sheets in position on the roofs. The loose-laid and balasted systems involve the placement of a very large sheet of the membrane over the roof surface and applying gravel on top to hold the same down on the top layer of roof insulation boards.There are also many mechanical fastening systems which clamp the membrane to the roof supporting structure. Known non-penetrating systems which stress clamp the membrane will cause a premature breakdown of the roof membrane in the clamped, stressed area. Other mechanical fastening systems have compression holding devices on top of the membrane and fixed to the building structure by means of a fastener that penetrates from above through the membrane. These "penetrating" fastener systems require some type of path or seal at each penetration, a requirement which leads to installation problems and reliability problems since it is very hard to assure that each and every one of up to several hundred penetrations in a roof are in fact adequately sealed. Wind uplift stress and membrane fluttering with such systems can result in roof failures.

The present invention relates to non-penetrating and non-stress clamping systems and improvements thereof. There have been several known non-penetrating systems. A system which has enjoyed substantial commercial acceptance for use with EPDM rubber sheets is the plate bonded system which has been actively marketed by Kelly Energy Systems Inc. of Waterbury, Connecticut. This plate bonded system is also the subject of applicant's U.S. Patent 4,162,597. This system utilizes relatively rigid masonite or the like pads, each approximately one foot square and made a quarter inch thick, which pads are held on the top of the roof insulation boards by a roof fastener, including a roof washer. The top of these plate bonding pads are then covered by an adhesive and the large EPDM sheets are rolled thereover and adhered thereto. This system exhibits very advantageous wind uplift response characteristics, due to the flexing of the relatively rigid pads and the transfer of forces from expanding air pressure to adjacent areas of the roof via the "balloon" formed because of the elastic nature of EPDM rubber sheet material.

For reinforced and non-ballooning membranes that are relatively inelastic, such as the thermoplastic PVC, Hypalon and copolymer alloy (CPA) membranes and other reinforced membranes, the plate bonded system has not been commercially adapted. Rather, various attachment systems have been used which rely upon the chemical characteristics of the PVC material to hold the same down in the roof installation. One such system is the Trocal (trademark) system developed by Dynamit Nobel AG Company of Germany, which system has been sold commercially in the United States for some years. For attaching the membrane, PVC coated washers are provided to hold down the roof insulation boards. These washers are then heat or solvent welded to the underside of the PVC roofing membrane to hold the membrane down. U.S. Patent 4,161,854 discloses certain features of this system.

Another known PVC membrane attaching system has been marketed by the company, Braas & Co. GmbH of Frankfurt, Germany. This system includes use of a circular piece of the PVC membrane material which is fastened by the roof fasteners in position at the top of the insulation boards. The pieces of PVC membrane material serve as a surface for applying adhesive so that they can be attached to the underside of the PVC roofing membrane. Braas Bulletin 1106, bearing identification number FOKB 1,500 4/77, discloses details of this system. The above-described Trocal and Braas systems have not been adapted for use with EPDM rubber membrane systems, apparently because of the much different characteristics of the unreinforced EPDM rubbers capable of substantial ballooning movement, and reinforced or relatively rigid thermoplastic PVC, Hyplon or CPA materials as regards their elasticity. Also the Trocal PVC system requires that the material at the coating of the washer be compatible with the overlying membrane to facilitate solvent or heat welding attachment.

These prior art systems for PVC membranes require a very large number of fasteners per unit area of the roof in order to meet the wind uplift test conditions that must be met in order to obtain certification for use in certain building applications. Underwriters Laboratory, Factual Mutual and Metro Dade (Florida) are three testing facilities that have established wind uplift and other tests for roofing systems. These systems usually require one fastener per 2–4 $ft^2$ of roof to acquire a 90 pounds per square foot (PSF) wind uplift rating. These and higher wind uplift ratings may be required for very tall buildings which experience high wind characteristics and wherein the wind uplift conditions are quite severe. Also, different geographic areas have different prevailing wind conditions, consequently resulting in different types of wind uplift resistance standards for different areas.

An object of the present invention is to provide a single ply membrane securing system and method of using same, which overcomes the problems of the prior art in so far as ease of installation, reliability of the finished roofing installations, the tolerance of the roofing installation to wind uplift conditions, and the total costs of the assembled roofs.

These and other objects of the present invention are achieved by providing a roofing membrane securing system which includes membrane securing units formed of flexible sheet material which exhibits an upwardly facing surface which can be adhered securely to the underside of the roofing membrane to hold it in position on a roof, wherein the membrane securing unit exhibits varying thickness across its area. Due to the varying thickness across the area of the flexible membrane securing unit advantages are achieved in adapting to roof fastener systems and in obtaining optimum response to wind uplift conditions due to transfer and sharing of forces on the membrane by adjacent securing units. Further advantages are obtained with respect to ease of assembly and total costs of installation of a roof.

Certain objects of the invention are advantageously achieved when the securing units of the invention are installed in a pre-determined manner with respect to the geometry of the sheets of material being attached. By positioning the securing units along the seams of the overlapping roofing membrane sheets, optimum reinforcement at the seams and at the securing points to the securing units is obtained. According to certain preferred embodiments, the securing units are placed in a geometric pattern over the field of the roof so as to form a "geodesic" dome like force transfer effect for transferring wind uplift forces through the membrane from each securing unit to respective adjacent securing units. Applicant believes that this configuration contributes to the very good wind uplift response characteristics that have been experienced during testing of prototypes of the present invention. In preliminary tests of experimental prototypes of the present invention, a 90 PSF wind uplift rating was obtained with only one fastener per 36 $ft^2$.

Especially preferred embodiments of the invention are designed for use for reinforced thermoplastic, Hypolan, CPA and PVC single ply membranes system or other relatively inelastic membrane system with compatible materials for the membrane and securing units. In especially preferred embodiments, the securing units are formed under factory conditions using two layers of the single ply membrane system to be attached with one of the layers being a piece of membrane that is smaller than the other piece, which smaller piece is then placed on the larger piece in the bottom position. The larger top piece then serves as a welding area for attaching to the overlying membrane. In certain preferred embodiments, the fastening washer which is placed over the top of the securing unit is also coated with material compatible for welding to the membrane. With this embodiment welding of the membrane to the top of the washer also takes place during the seaming and welding to the securing units.

By placing the securing units along the seams of the sheets of membrane being attached, it is accomplished that one can very easily install the membranes in a reliable, repeatable manner and also facilitate the use of available automatic mechanized seam welding equipment for simultaneously forming the welding seam and the securement at the securing units.

Since the preferred embodiments of securing units are to be manufactured under controlled factory conditions, a precise location of the preformed opening for the fastener and precise location and sizing of the material making up the securing unit can be readily accomplished. In certain preferred embodiments, the roofing washer can also be incorporated within or connected to the securing unit under factory conditions with the corresponding assurance and reliability and consistency of manufacturing. This reliability and consistency in manufacturing is important especially in the roofing industry where the on site installation conditions are many times adverse due to weather conditions, unskilled roof installation personnel, varied roof protrusions, and other construction details, leading to otherwise very difficult to maintain installation consistencies.

Another important advantage of the invention is that the geometric location of the securing units, coupled with the construction of the securing units, minimizes the number of fastener screws that are required to hold down the membrane, thus simplifying the roof assembly installation. In most roofing installations of preferred embodiments of the invention, the fasteners used to hold the securing units for the membrane are not required for holding the insulation boards in position underneath. The number and location of fasteners and securing units is determined by the total geometric area of the field of the roof being attached and the width of the sheets being installed. Although additional fasteners may be needed to hold down insulation boards, only a very small number are usually required to hold down each four foot by eight foot insulation board, for example.

In especially preferred arrangements of the present invention, the fasteners and securing units for the membrane are placed at six foot intervals, thus only one fastener is needed for each approximately 36 square feet of the field of the roof, substantially less than prior art arrangements with similar thermoplastic membranes exhibiting similar wind uplift characteristics. In certain preferred embodiments, the securing units are constructed so as to have different strength characteristics in different directions corresponding to the in use positioning of the securing units in a roof installation. The increased strength characteristics are directed along lines corresponding to lines leading to the next adjacent securing units, whereby optimum transfer of forces between their respective securing units is obtained.

In especially simple to construct preferred embodiments, the different directional strength characteristics are obtained by utilizing two square pieces of membrane material welded together and angularly offset with respect to one another so that the corners thereof lie on respective eight radial lines leading from the center of the securing unit in a symmetrical manner.

Further objects, features, and advantages of the present invention will become more apparent from the following description when taken with the accompanying drawings(s) which show, for purposes of illustration only, several embodiments in accordance with the present invention.

DETAILED DESCRIPTION OF THE DRAWINGS

Figure 1:
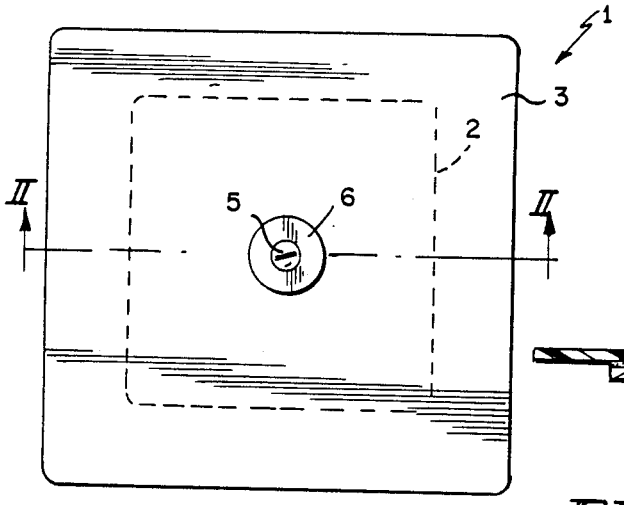
FIG. 1 is a top view of a flexible securing unit constructed in accordance with a preferred embodiment of the present invention, with a roofing washer and screw assembled therewith.
Figure 2:
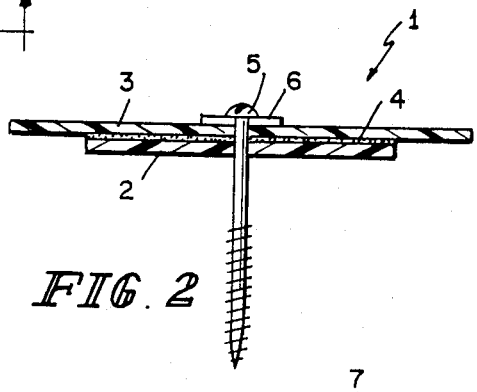
FIG. 2 is a sectional view taken along line II—II of FIG. 1.

Throughout the drawings figures, like reference numerals are used to indicate similar structure. FIGS. 1 and 2 depict the flexible membrane securing unit 1 which is composed of a first piece 2 of PVC roofing membrane material which is heat or solvent welded along its upper surface to the bottom surface of a larger piece of PVC membrane material 3. Other membrane material could also be used according to preferred contemplated embodiments provided the material is compatible for purposes of achieving solvent welding, heat welding or the like. Other thermoplastic reinforced membrane material contemplated by the invention includes CPA and Hypalon material.

A heat or solvent weld connection is depicted at 4. This securing unit 1 is preferably pre-manufactured with precise dimensions and forms a flexible securing unit which has a double layer thickness over the surface area of the bottom piece 2. In an especially preferred embodiment, the bottom piece 2 is formed as one foot by one foot square of 50 mil thick sheet material and the top piece 3 is formed by an 8 inch by 8 inch 50 mil thick sheet of the same material. The roofing membrane is also made of the same sheet material.

The securing units 1 are anchored in position on the roof assembly by means of a roof fastener 5, including a two inch diameter roofing washer 6.

Figure 3A:
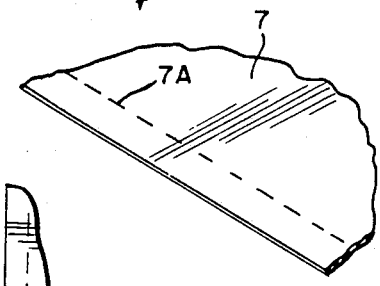
FIG. 3A is a schematic perspective illustration showing installation details for the system structured in accordance with preferred embodiments of the invention.
Figure 3:
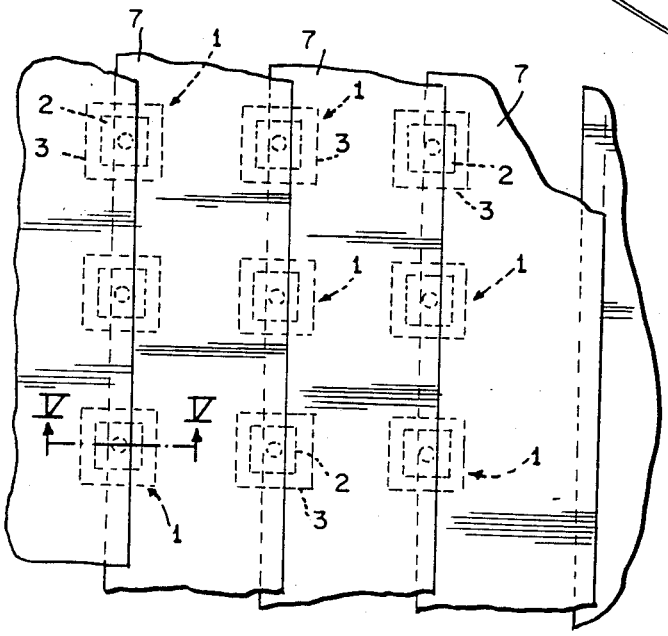
FIG. 3 is a schematic top view showing a portion of the field of a roof and depicting the pattern of the sheets of the roofing membrane and the securing units in an assembled condition.

FIG. 3 is a top schematic view of a section of the field of roof with a completed installation, depicting the location of the securing units 1 underneath the sheets 7 of PVC roofing material. The securing units 1 are located under the seams 8 along the adjacent sheets 7 which overlap at these seams 8. With this arrangement, the seams 8 can be simultaneously heat welded along with the securing unit 1, so that a welded connection of the bottom of sheets 7 with the upper surface of the top piece 3 of the retainer unit 1 is achieved. In certain preferred embodiments, the washer 6 is a PVC coated washer, which also is heat welded to the underside of the bottom sheets 7 during the seaming process. A conventional automatic seam welding machine can be utilized for carrying out the seaming process once the securing units 1 and sheets 7 are properly positioned.

Figure 4:
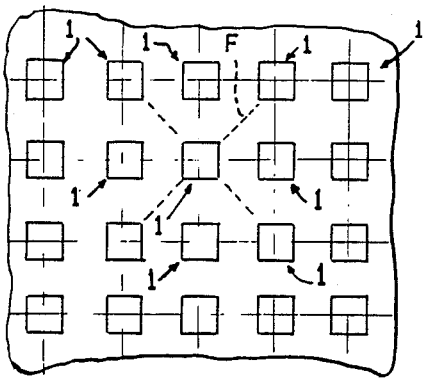
FIG. 4 is a schematic top view of a roof installation showing preferred arrangements of the distribution and location of the under the membrane securing unit.

The assembly of a roofing installation utilizing the securing units 1 of the present invention is especially simple and easy for the installers to carry out in a reliable and repeatable manner without requiring undue training. The following is a brief description of the steps involved in installing the roofing system utilizing he present invention. First it is assumed that the section of the field of the roof which is to be covered is provided with insulation boards, appropriate edge detail flashing, and the like. Referring to FIG. 3 and FIG. 3A, the first step is to accurately position a first sheet 7 of the material to be attached along the edge of the field to be covered. In FIG. 3, the right hand sheet 7 is appropriately disposed and anchored at its right hand side into the adjoining roof edge portion. Once the first right hand sheet 7 is in position, the entire field to be covered is marked with a grid pattern for location of the securing units 1, since they are to be secured in a predetermined geometric pattern that relates to the width of the sheets 7 and is independent of the disposition of the underlying insulation boards. FIG. 4 schematically depicts an overall grid pattern conforming to this arrangement, which is approximately 6'×6' in each direction, starting with the center of seams 8 that are to be formed at the overlapping edges of the sheets 7 when installed. Presuming a 74" wide sheet of material, this will result in about a two inch overlap seam region 8. The securing units 1 are located and secured in position by automatic screwing machine guns or the like. The width of the sheets 7 and the width of the seam 8 can be selected to assure a proper seam connection and also assure a secure connection to the securing units. According to preliminary prototype tests this seam 8 of the present invention utilizes less sheet material than prior lap fastening systems because the sheet overlap is smaller.

The next step is to bring in the next sheet 7 of material and overlay its right hand edge on top of the left hand edge of the sheet 7, which now is disposed rolled back over the top of the securing units 1 that are lines up. Subsequently, this first seam 8 (right side of FIG. 3) is welded by an automatic welding machine, simultaneously welding the seam overlap top of the securing units 1, namely the top surface of the section of the sheet 7, as well as the bottom sheet 7, to the pieces 3 of these units. In certain embodiments were the washer 6 is also "PVC" coated, this would also simultaneously be heat welded together with the seaming operation. The subsequent sheets need merely be applied across the field of the roof in the left direction in a similar manner. Factory installed marking 7A can be applied to the sheet 7 so as to locate the sheets as the top sheet is put on the bottom sheet. That is the left hand side of the bottom sheet in installations as shown in FIG. 3 would be provided with this marking a predetermined distance from the edge so that the workmen could in a very simple manner just roll out the next sheet over the top thereof and align it by this marking.

FIG. 4 schematically depicts an especially advantageous grid pattern for the securing units and seams 8 of the sheets of PVC material which results in a "geoderic dome" type of distribution of the wind uplift forces between the flexible membrane securing units 1 from unit 1 to 1. This redistribution of forces in this relatively inelastic membrane material results in enhanced advantageous responses to wind uplift conditions.

Figure 5:
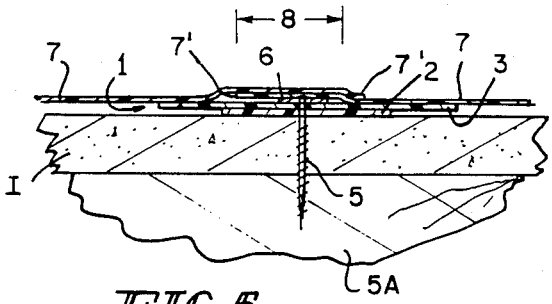
FIG. 5 is a sectional view of the complete roofing assembly taken along the line V—V of FIG. 3.

FIG. 5 schematically depicts a first preferred arrangement of the securing units 1 vis-a-vis the edges 7' of the overlapping seam section 8 of the adjacent sheet 7. FIG. 5 also schematically depicts the insulation boards I, and the roof support structures 5 which the fasteners 5 are fastened to. It will be understood that the present invention relates to attachments to many different types of insulation and roof support structure including concrete supports, metal decking, etc. From FIG. 5, it is seen that the securing units 1 are symmetrically disposed with respect to the centerline of the seam section 8. This particular arrangement does require that the seam section 8 be sufficiently wide enough to accommodate attachment over the top of the washers to thus provide smooth transition from the sheet 7 to the underlying securing unit 1. This arrangement is especially advantageous in that it is very easy to install as the installers can locate by "eye" the securing units vis-a-vis the sheet edges 7' of the sheet 7 already in place, especially for the first left hand sheet being applied. The remainder of the securing units can then be located using this reference line.

Figure 6:
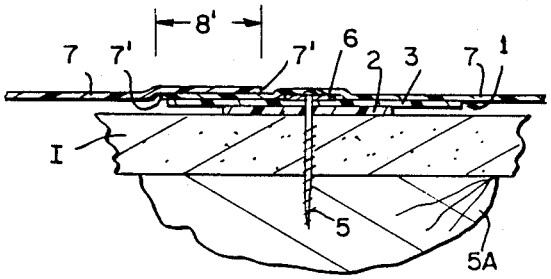
FIG. 6 is a view similar to FIG. 5, but showing a different disposition of the seam between the top layers of membrane with respect to the securing units.

The FIG. 6 embodiment differs from the FIG. 5 embodiment only in that the location of the seam section 8' is set off to one side with respect to the center of the retainer units 1. In this arrangement, the edge 7' of the bottom sheet 7 is aligned with the edge of the top sheet 3 of the retainer unit 1, while the adjacent top sheet 7 is overlapped only a small portion over the edge of the sheet 7 and does not reach to the location of the center of the retainer unit 1. Although this embodiment leads to a slightly non-symmetrical distribution of forces at the retainer units 1, it still obtains the advantages of the multiple layer retainer unit and also facilitates slightly narrower seam section 8', thereby saving material.

Figure 7:
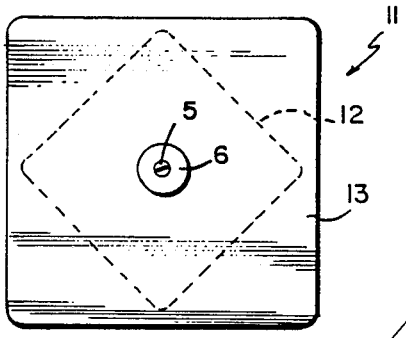
FIG. 7 is a view similar to FIG. 1, showing another preferred embodiment of a securing unit.
Figure 8:
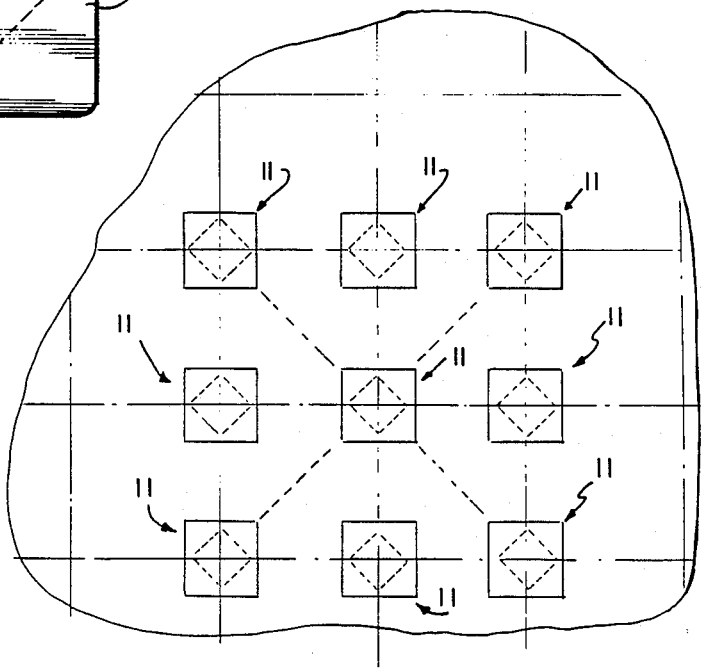
FIG. 8 is a view similar to FIG. 4, showing a preferred disposition of securing units constructed in accordance with the embodiment of FIG. 7.

The FIG. 7 embodiment differs from the embodiment of FIGS. 1 and 2 only in that the lower piece of membrane 12 is offset angularly with respect to the upper roofing membrane piece 13 by 45 degrees and that the respective eight corners of the two pieces 12 and 13 lie on radial lines leading from the opening for the fasteners 5, 6 in a symmetrical manner. With this configuration installed in a roof as shown in FIG. 8, the radial lines corresponding to the corners of the respective squares extend in directions towards the next adjacent securing units to thereby optimize the transfer of forces between the securing units.

Figure 9:
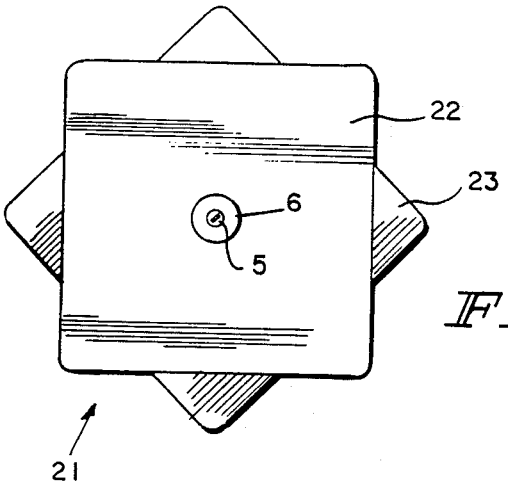
FIG. 9 is a view similar to FIG. 1, showing yet another preferred embodiment of a securing unit.

The FIG. 9 embodiment differs from the FIG. 7 embodiment only in that the two pieces of membrane material 22, 23 making up the securing unit 21 are of the same size.

Figure 10:
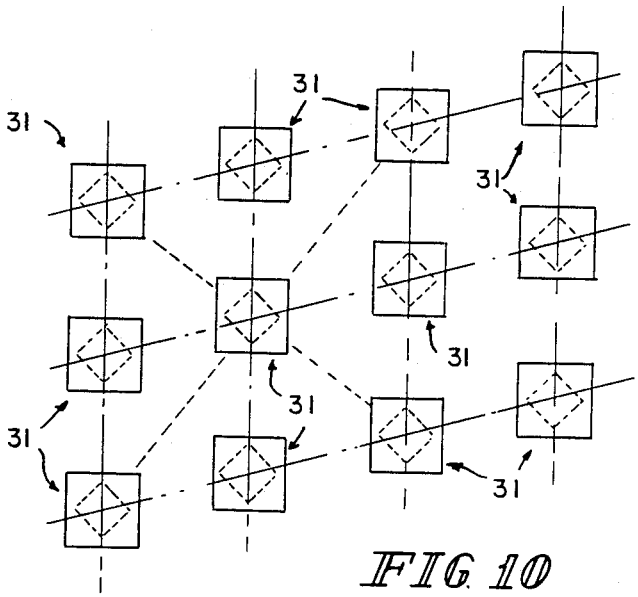
FIG. 10 is a view similar to FIGS. 4 and 8, showing another preferred embodiment of the disposition of securing units.

FIG. 10 schematically depicts a parallelogram distribution of the securing units 11. This distribution, when coupled with appropriate orientation of the maximum strength sections of the securing units, also results in a regular distribution of forces between securing units and fasteners. For example, with 3 foot spacing between seams, the next adjacent row of securing units 11 can be offset by 3 feet to form the pattern shown in FIG. 10.

With location of the securing units in the field of the roof according to the above-described preferred embodiments, optimum transmission of the stresses through the membrane minimizes the uplifting pull on the individual fasteners. The wind uplift pressure is thereby transferred under sheet stress and is absorbed in the securing units via horizontal components of the stress with limitation of the uplift vertical pull at the fasteners. Also, due to the double reinforcement at the lap seams of the sheets of material, and the location and directional strengthening of the securing units thereunder, the adverse effects due to cocking or the tilting of the fasteners and washers during wind uplift conditions and during installation are minimized. Even if one layer of membrane is damaged or stresses by tilting of the fastener and/or washers, the double layer of sheets and the construction of the securing units provide additional supporting layers for transferring forces.

Figure 11:
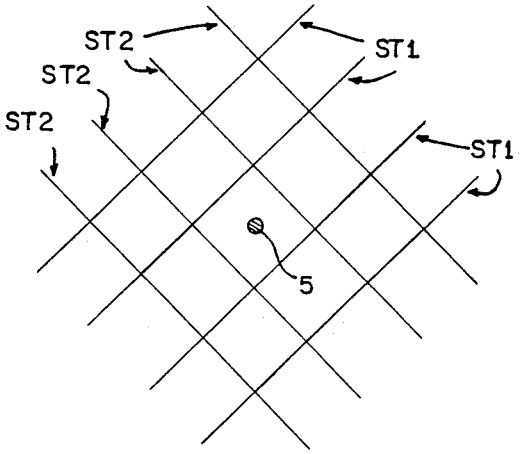

Also, with reinforced membranes having fiber strands reinforcing like, the multilayer angularly spaced securing units effectively provides strands extending at an angle to one another. These strands are less likely to break and permit a ripping of the membrane due to their angular orientation. FIG. 11 schematically depicts the orientation of reinforcing strands in a two layer securing unit adjacent a fastener screw holding the unit imposition in FIG. 11, St1 depicts strands in one membrane layer and St2 depicts the reinforcing strands in the second layer of the securing units. Reinforcing strands in the membrane sheets being held could also be oriented in yet another direction vis-a-vis the strands St1 and St2 to further enhance the resistance to failure at the fasteners.

Although the most preferred embodiments illustrated and described are constructed with the securing units having the larger piece of membrane at the top in a roof installation, many of the advantages of the invention could be experienced with these parts reversed. It these parts are reversed so that the smaller piece is on top, care should be exercised to assure a good weld over substantially the entire upwardly facing surface of the securing units.

From the preceding description of the preferred embodiments, it is evident that the objects of the invention are attained, and although the invention has been described and illustrated in detail, it is to be clearly understood that the same is by way of illustration and example only and is not to be taken by way of limitation. The spirit and scope of the invention are to be limited only by the terms of the appended claims.

What is claimed is:

1. A roof membrane securing unit formed of a relatively rigid washer means and flexible membrane material exhibiting an upwardly facing surface which can be adhered securely to an underside to a flexible roof membrane to hold the roof membrane in position on a roof, wherein said securing unit is formed of a material which is compatible with material forming the flexible roof membrane for purposes of achieving welding of the securing unit to the flexible roof membrane, and wherein the flexible membrane material of said membrane securing unit exhibits varying thickness across its surface area and is formed separately of the roof membrane to be secured thereby, wherein said membrane securing unit includes an opening for accommodating penetration thereof by a roof fastener, and wherein the flexible membrane material of said membrane securing unit is thicker adjacent said opening than adjacent substantial portions of its edges.

2. Roof membrane securing unit according to claim 1, wherein said securing unit is formed of two pieces of strand reinforced PVC or the like material, said two pieces being angularly off set with respect to one another so that their reinforcing strands extend in different directions.

3. Roof membrane securing unit according to claim 1, wherein said membrane securing unit is formed of two substantially square pieces of substantially similar size.

4. Roof membrane securing unit according to claim 3, wherein the pieces are angularly offset with respect to one another so that their corners are located on respective eight radial lines extending from the center of the membrane securing unit in a symmetrical pattern.

5. Roof membrane securing unit according to claim 1, wherein the flexible membrane material of the membrane securing unit exhibits different strength characteristics in different radial directions from the opening.

6. Roof membrane securing unit according to claim 5, wherein the membrane securing unit exhibits maximum strength in directions corresponding to respective adjacent securing units when in an installed position on a roof.

7. Roof membrane securing unit according to claim 1, wherein said membrane securing unit is formed of two different size pieces of similar material as the material of the roof membrane to be attached, said two pieces including a smaller piece and a larger piece, said smaller and larger pieces being welded to one another over their respective facing surfaces.

8. Roof membrane securing unit according to claim 7, wherein the pieces are square and are angularly offset with respect to one another so that their corners are located on respective eight radial lines extending from the center of the membrane securing unit in a symmetrical star shaped pattern.

9. Roof membrane securing unit according to claim 7, wherein the pieces are substantially square, with the smaller piece being disposed to be above the larger piece when in an installed position on a roof.

10. Roof membrane securing unit according to claim 7, wherein the pieces are made of reinforced theremoplastic PVC material and have a thickness between 40 and 60 mil.

11. Roof membrane securing unit according to claim 7, wherein the pieces are substantially square, with the smaller piece being disposed to be at the bottom position when in an installed position on a roof.

12. Roof membrane securing unit according to claim 11, wherein the smaller piece is between three and five inches on a side and the larger piece is between six and ten inches on a side.

13. Roof membrane securing unit according to claim 11, wherein the smaller piece is between three and five inches on a side and the larger piece is between six and ten inches on a side.

14. A roof membrane securing unit formed of flexible membrane material exhibiting an upwardly facing surface which can be adhered securely to an underside of a flexible roof membrane to hold the roof membrane in position on a roof, wherein said securing unit if formed of a material which is compatible with material forming the flexible roof membrane for purposes of achieving welding of the securing unit to the flexible roof membrane, and wherein said membrane securing unit exhibits varying thickness across its surface area and if formed separately of the roof membrane to be secured thereby, wherein said membrane securing unit includes an opening for accomodating penetration thereof by a roof fastener, and wherein said membrane securing unit si thicker adjacent said opening than adjacent substantial portions of its edges, further comprising a washer securely held at the securing unit and surrounding the opening for the fastener, whereby the securing unit with washer can be manufactured remotely from the roof site and then be applied as a unit at the roof installation site.

15. Roof membrane securing unit according to claim 14, wherein said washer is a PVC coated washer, and wherein the membrane is a PVC or the like membrane which can be heat or solvent welded to the washer and an upwardly facing surface of the flexible material of the membrane securing unit.

16. A single ply roof membrane roofing installation comprising:

a plurality of roof membrane securing units, each being formed of a relatively rigid washer means and a flexible membrane material exhibiting an upwardly facing surface which can be adhered securely to an underside of a roof membrane to hold the roof membrane in position on a roof, said membrane securing units each being formed of at least two flexible membrane layers with an uppermost membrane layer exhibiting an upwardly facing surface when in an installed position in a roof, at least one of said membrane layers including reinforcing fibrous strands, the upwardly facing surface of the uppermost membrane layer being composed of material which is compatible with material forming the flexible roof membrane for purposes of achieving welding of an underside of the roof membrane to be held at the securing unit to accommodate attachment of the roof membrane to the securing units.

17. An installation according to claim 16, wherein each of said membrane securing units exhibits varying thickness across its surface area with a central area of the securing unit being substantially thicker than at substantial portions of the edge areas of the securing unit.

18. An installation according to claim 16, wherein said securing units are disposed under seam areas of the roofing membrane formed by overlapping edge sections of sheets of the roofing membrane material.

19. An installation according to claim 18, wherein said securing units are connected by one of heat welding and solvent welding to the roofing membrane material in the seam areas.

20. An installation according to claim 19, wherein said securing units are distributed over the field of the roof in a regular pattern corresponding to the distance between the seam areas of the overlying sheets of roofing membrane.

21. An installation according to claim 20, wherein said securing units are distributed at corners of respective parallelogram shaped sections of the field of the roof, said parallelogram shaped sections having an altitude corresponding to the distance between seam areas of the overlying sheets of roofing membrane.

22. An installation according to claim 21, wherein each securing unit is configured to have increased strength characteristics in directions corresponding to next adjacent securing units.

23. An installation according to claim 22, wherein each securing unit is made of two parallelogram shaped pieces of material that are angularly offset with respect to one another so that corners of the respective pieces are located on respective eight radial lines extending from the centers of the securing units in a symmetrical pattern, whereby said radial lines extend to respective adjacent similarly constructed securing units.

24. An installation according to claim 21, wherein said parallelogram shaped sections are square.

25. An installation according to claim 24, wherein said pieces are square.

26. A method of manufacturing a roof membrane securing unit formed of flexible material and exhibiting an upwardly facing surface which can be adhered securely to an underside of a roof membrane to hold the roof membrane in position on a roof, said membrane securing unit exhibiting varying thickness across its surface area, said method comprising:

forming a first piece of roofing membrane material of a predetermined first size, forming a second piece of roofing membrane material formed of a predetermined second size, and welding the first and second pieces together along their respective facing surface areas, said facing surface areas of the first and second pieces being composed of material which is compatible with one another to accommodate said welding.

27. A method according to claim 26, wherein the first and second pieces are formed of thermoplastic roofing membrane material, and wherein said welding includes one of heat and solvent welding of said two pieces together.

28. A method according to claim 27, further comprising providing a roof fastener accommodating opening in a central area of the securing unit.

29. A method according to claim 28, further comprising encapsulating a washer in the securing unit around the opening.

30. A method according to claim 29, wherein said washer is coated on one side with the same welding compatible material as the first and second pieces are formed of.

31. A method according to claim 30, wherein said welding includes heat welding said two pieces together.

32. A method according to claim 31, wherein said pieces are square and of substantially different size.

33. A method of installing a single ply roof membrane comprising;

assembling a plurality of roof membrane securing units is formed of a relatively rigid washer means and flexible material which exhibits an upwardly facing surface which can be adhered securely to an underside of a roof membrane to hold the same in position of a roof, distributing the membrane securing units in a predetermined matter over the field of the roof to be covered by the membrane sheets along an overlapping seam area of adjacent roofing membrane sheets and welding the overlapping seam areas of the membrane sheets along with the membrane securing units so as to simultaneously form the sheet seams and attach the sheets to the underlying securing units.

34. A method according to claim 33, wherein said securing units are connected by heat welding to the roofing membrane material in the seam areas.

35. A method according to claim 34, wherein said securing units are distributed over a field of a roof in a regular pattern corresponding to the distance between the seam areas of the overlying sheets of roofing membrane.

36. A method according to claim 33, wherein each securing unit exhibits varying thickness across its surface area and is formed by welding at least two pieces of roofing membrane material together under factory conditions.

37. A method according to claim 33, wherein said upwardly facing surface is composed of material having chemical composition characteristics compatible to said roof membrane to accommodate said welding.

38. A method according to claim 35, wherein said securing units are distributed at corners of respective parallelogram shaped sections of the roof, said parallelogram shaped sections having an altitude corresponding to the distance between the seam areas of the overlying sheets of roofing membrane.

39. A method according to claim 38, wherein said parallelogram shaped sections are square.

40. A method according t claim 38, wherein each securing unit is configured to have increased strength characteristics in directions corresponding to the location of the next adjacent securing units.

41. A method according to claim 40, wherein each securing unit is made of parallelogram shaped pieces of material that are angularly offset with respect to one another so that the corners of the respective pieces are located on respective eight radial lines extending from the centers of the securing units in a symmetrical pattern, whereby said radial lines extend to respective adjacent similarly constructed securing units.

42. A method according to claim 41, wherein said parallelogram shaped sections are square, and wherein said pieces are square.

43. Roof membrane securing unit for retaining a single-ply flexible roofing membrane in position on a roof, comprising:

relatively rigid washer means, at least two flexible membrane layers, at least one of said membrane layers including reinforcing fibrous stands, and wherein an upwardly exterior surface of the securing unit membrane layers is composed of material compaticle with material forming an underside of a roof membrane to be secured at the securing unit so as to accommodate attachment of said surface to said underside of the roof membrane.

44. Roof membrane securing unit according to claim 43, wherein at least two of said membrane layers include reinforcing fibrous strands, said layers being angularly offset with respect to one another with a corresponding offset of the direction of extension of their reinforcing strands.

45. Roof membrane securing unit according to claim 44, wherein at least two of said membrane layers include reinforcing fibrous strands, said layers being angularly offset with respect to one another with a corresponding offset of the direction of extension of their reinforcing strands.

46. Roof membrane securing unit according to claim 43, further comprising a central through opening in the securing unit membrane layers for accommodating penetration thereof by roof fastener screw means.

47. Roof membrane securing unit according to claim 46, wherein said at least two membrane layers have substantially different surface areas and are attached to one another along their facing surfaces by welding and are disposed so as to be respectively symmetrically arranged with respect to said central opening.

48. Roof membrane securing unit according to claim 47, wherein the central opening is the only opening through said membrane layers, said central opening exhibiting a substantially constant through diameter in all of said layers.

49. Roof membrane securing unit according to claim 48, wherein at least two of said membrane layers include reinforcing fibrous strands, said layers being angularly offset with respect to one another with a corresponding offset of the direction of extension of their reinforcing strands.

50. A roof assembly comprising:

roof support structure, a single-ply flexible roofing membrane disposed above the roof structure, a flexible roof membrane securing unit disposed underneath the roof membrane and exhibiting an upwardly facing surface which is composed of material compatible with material forming an underside of the roof membrane to accommodate securing of the roof membrane thereto, said upwardly facing surface being secured to the underside of the roof membrane, said roof membrane securing unit being composed of at least two flexible membrane layers secured together along their facing surfaces, and roof fastener means disposed completely under the roof membrane and serving to hold the securing unit in position on the roof structure, said roof fastener means including a relatively rigid washer means overlying at least portions of the flexible roof membrane securing unit.

51. A roof assembly according to claim 50, wherein at least two of said membrane layers include reinforcing fibrous strands, said layers being angularly offset with respect to one another with a corresponding offset of the direction of extension of their reinforcing strands.

52. A roof assembly according to claim 50, wherein at least one of the membrane layers includes reinforcing fibrous strands.

53. A roof assembly according to claim 50, further comprising a central through opening in the securing unit for accommodating penetration thereof by the roof fastener means.

54. A roof assembly according to claim 53, wherein at least two membrane layers are secured to one another along their facing surfaces by welding and are disposed so as to be respectively symmetrically arranged with respect to said central opening.

55. A roof assembly according to claim 53, wherein the upwardly facing surface of the securing unit is secured by welding to the underside of the roof membrane.

56. A roof assembly according to claim 53, wherein at least two membrane layers have substantially different surface area and are secured to one another along their facing surfaces by welding and are disposed so as to be respectively symmetrically arranged with respect to said central opening.

57. A roof assembly according to claim 56, wherein the central opening is the only opening trough said membrane layers, said central opening exhibiting a substantially constant through diameter in all of said layers.

58. A roof assembly according to claim 57, wherein at least two of said membrane layers include reinforcing fibrous strands, said layers being angularly offset with respect to one another with a corresponding offset of the direction of extension of their reinforcing strands.

59. A roof assembly according to claim 50, further comprising a plurality of said securing units disposed in a pattern underneath the roof membrane, and wherein said securing units are disposed under seam areas of the roofing membrane formed by overlapping edge sections of sheets of the roofing membrane material.

60. A roof assembly according to claim 59, wherein said securing units are distributed over the field of the roof in a regular pattern at a spacing from one another corresponding to the distance between the seam areas of the overlying sheets of roofing membrane.

61. A roof assembly according to claim 60, wherein said securing units are distributed at corners of respective parallelogram shaped sections of the field of the roof, said parallelogram shaped sections having an altitude corresponding to the distance between seam areas of the overlying sheets of roofing membrane.

62. A roof assembly according to claim 61, wherein each securing unit is made of two parallelogram shaped pieces of flexible membrane material that are angularly offset with respect to one another so that corners of the respective pieces are located on respective eight radial lines extending from respective centers of the securing units in a symmetrical pattern, whereby said radial lines extend to respective adjacent similarly constructed securing units.

63. A roof membrane securing unit formed of flexible membrane material exhibiting an upwardly facing surface which can be adhered securely to an underside of a flexible roof membrane to hold the roof membrane in position on a roof, wherein said securing unit is formed of a material which is compatible with material forming the flexible roof membrane for purposes of achieving welding of the securing unit to the flexible roof membrane, and wherein said membrane securing unit exhibits varying thickness across its surface area and is formed separately of the roof membrane to be secured thereby, wherein said membrane securing unit includes an opening for accomodating penetration thereof by a roof fastener, and wherein said membrane securing unit is thicker adjacent said opening than adjacent substantial portions of its edges, wherein said membrane securing unit is formed of two different size pieces of similar material as the material of the roof membrane to be attached, said two pieces including a smaller piece and the larger piece, said smaller and larger pieces being welded to one another over their respective facing surfaces.

64. A single ply roof membrane roofing installation comprising:

a plurality of roof membrane securing units, each being formed of a flexible material and exhibiting an upwardly facing surface which can be adhered securely to an underside of a roof membrane to hold the roof membrane in position on a roof, said membrane securing units each being formed of at least two flexible membrane layers with an uppermost membrane layer exhibiting an upwardly facing surface when in an installed position on a roof, at least one of said membrane layers including reinforcing fibrous strands, the upwardly facing surface of the uppermost membrane layer being composed of material which is compatible with material forming the flexible roof membrane for purposes of achieving welding of an underside of the roof membrane to be held at the securing unit to accommodate attachment of the roof membrane to the securing units, wherein each securing unit is made of two parallelogram shaped pieces of material that are angularly offset with respect to one another so that corners of the respective pieces are located on respective eight radial lines extending from the centers of the securing units in a symmetrical pattern, whereby said radial lines extend to respective adjacent similarly constructed securing units.

* * * * *